US010991523B2

(12) United States Patent
Weng et al.

(10) Patent No.: US 10,991,523 B2
(45) Date of Patent: Apr. 27, 2021

(54) KEYBOARD DEVICE

(71) Applicant: Chicony Electronics Co., Ltd., New Taipei (TW)

(72) Inventors: Shin-Chin Weng, New Taipei (TW); Chun-Chieh Chan, New Taipei (TW); Chao-Chin Hsieh, New Taipei (TW); Chih-Feng Chen, New Taipei (TW)

(73) Assignee: Chicony Electronics Co, , Ltd., New Taipei (TW)

( * ) Notice: Subject to any disclaimer, the term of this patent is extended or adjusted under 35 U.S.C. 154(b) by 300 days.

(21) Appl. No.: 16/231,954

(22) Filed: Dec. 25, 2018

(65) Prior Publication Data

US 2020/0035426 A1 Jan. 30, 2020

(30) Foreign Application Priority Data

Jul. 24, 2018 (TW) ..... 107125556

(51) Int. Cl.
*H01H 9/00* (2006.01)
*H01H 13/7065* (2006.01)

(52) U.S. Cl.
CPC ..... *H01H 13/7065* (2013.01); *H01H 2221/04* (2013.01); *H01H 2221/058* (2013.01)

(58) Field of Classification Search
CPC ..... H01H 13/7065; H01H 2221/04; H01H 2221/058
USPC ..... 335/205
See application file for complete search history.

(56) References Cited

U.S. PATENT DOCUMENTS 8,629,362 B1 * 1/2014 Knighton ..... H01H 13/52 200/344
2012/0313738 A1 * 12/2012 Chang ..... H01H 13/702 335/205
2013/0154940 A1 * 6/2013 Gan ..... H01H 36/0073 345/168
2013/0249658 A1 * 9/2013 Kan ..... H01H 36/00 335/205
2015/0243456 A1 * 8/2015 Hsu ..... H01H 13/20 200/344
2015/0332875 A1 * 11/2015 Hsu ..... H01H 3/125 200/344
2017/0178841 A1 * 6/2017 Hsu ..... H01H 3/12
2018/0019078 A1 * 1/2018 Chen ..... H01H 13/023
2020/0035426 A1 * 1/2020 Weng ..... H01H 3/125
2020/0051760 A1 * 2/2020 Lin ..... H01H 3/125
2020/0357583 A1 * 11/2020 Yang ..... H01H 13/20
(Continued)

*Primary Examiner* — Shawki S Ismail
*Assistant Examiner* — Lisa N Homza
(74) *Attorney, Agent, or Firm* — CKC & Partners Co., LLC

(57) ABSTRACT

A keyboard device includes a base plate and a plurality of keyswitches disposed on the base plate. At least one of the keyswitches includes a keycap, two linkages, and two magnetic attraction members. The linkages are connected between the base plate and the keycap and configured to guide the movements of the keycap toward and away from the base plate. The magnetic attraction members are rotatably connected to the linkages, respectively, and are configured to attract each other. When the magnetic attraction members abut against each other, the keycap is at a highest position relative to the base plate. When the keycap moves toward the base plate from the highest position, the magnetic attraction members are separated from each other.

13 Claims, 5 Drawing Sheets

(56) References Cited

U.S. PATENT DOCUMENTS

2020/0357584 A1* 11/2020 Morrison ..... H01H 13/50
2020/0395178 A1* 12/2020 Chao ..... H01H 13/52

* cited by examiner

KEYBOARD DEVICE

CROSS-REFERENCE TO RELATED APPLICATION

This application claims priority to Taiwan Application Serial Number 107125556, filed Jul. 24, 2018, which is herein incorporated by reference.

BACKGROUND

Technical Field

The present disclosure relates to a keyboard device.

Description of Related Art

Currently, the keyboard is one of the indispensable input devices to enter text or numbers while using a personal computer (PC). Moreover, consumer electronic products used in daily life or large-scale processing equipment used in the industrial sector require key structure units as input devices to be operated.

In a traditional keyboard device, a keyswitch adopts the pressing design in which a position returning member (such as a rubber dome) and a connecting structure (such as a scissors-like mechanism) are disposed between the keycap and the base plate. When the keycap is pressed by a user, the position returning member provides an elastic recovery force to the keycap, so as to drive the keycap to return to the position at which the keycap is not pressed with the guidance of the connecting structure.

For a current notebook computer, its development direction is to be light and thin, therefore the keyboard structure thereof must be improved to meet the above requirements and also has to reduce the overall vertical height of the keyswitches and simplify the mechanism, so as to better meet the current changing direction and market demand of electronic devices. However, the design of the conventional scissors-like supporting structure with a rubber elastomer occupies a certain vertical height. As a result, a certain height space must be reserved for the keyboard of the notebook computer for installation, which makes the overall thickness of the notebook computer unable to be reduced.

Accordingly, how to provide a keyboard device to solve the aforementioned problems becomes an important issue to be solved by those in the industry.

SUMMARY

An aspect of the disclosure is to provide a keyboard device which can effectively solve the aforementioned problems.

According to an embodiment of the disclosure, a keyboard device includes a base plate and a plurality of keyswitches. At least one of the keyswitches includes a keycap, two linkages, and two magnetic attraction members. The keycap is located over the base plate. The linkages are connected between the base plate and the keycap and configured to guide movements of the keycap toward and away from the base plate. The magnetic attraction members are rotatably connected to the linkages respectively and configured to attract each other. When the magnetic attraction members abut against each other, the keycap is at a highest position relative to the base plate. When the keycap moves toward the base plate from the highest position, the magnetic attraction members are separated from each other.

In an embodiment of the disclosure, one of the magnetic attraction members includes a main body portion, a connecting portion, and a magnetic attraction portion. The main body portion is rotatably connected to a corresponding one of the linkages through the connecting portion. The magnetic attraction portion is connected to the main body portion.

In an embodiment of the disclosure, the connecting portion is a pivotal shaft and is pivotally connected to said corresponding one of the linkages.

In an embodiment of the disclosure, the connecting portion and the linkage connected thereto are formed in one piece. A thickness of the connecting portion is reduced relative to the main body portion and the linkage connected thereto, such that the connecting portion forms a flexible structure.

In an embodiment of the disclosure, the connecting portion and the magnetic attraction portion are respectively adjacent to two opposite side edges of the main body portion.

In an embodiment of the disclosure, the magnetic attraction portion is connected to an outer edge of the main body portion.

In an embodiment of the disclosure, the magnetic attraction portion is embedded in the main body portion.

In an embodiment of the disclosure, the magnetic attraction portion is a magnet or includes a ferromagnetic material.

In an embodiment of the disclosure, the magnetic attraction portion is a magnet. The base plate has a hole. When the keycap is at a lowest position relative to the base plate, an orthogonal projection of the magnetic attraction portion projected onto the base plate is contained within the hole.

In an embodiment of the disclosure, each of the linkages has a lower engaging shaft and an upper engaging shaft respectively engaged with the base plate and the keycap. The linkages are arranged horizontally and symmetrically.

In an embodiment of the disclosure, each of the linkages is U-shaped and includes a first arm and two second arms. The first arm is connected parallel to the upper engaging shaft. Each of the second arms is connected between the first arm and the lower engaging shaft. The second arms are respectively extended from two ends of the first arm.

In an embodiment of the disclosure, a distance between the lower engaging shafts is smaller than a distance between the upper engaging shafts. The magnetic attraction members extend toward each other.

In an embodiment of the disclosure, at least one of the lower engaging shafts is pivotally connected to the base plate. At least one of the upper engaging shafts is slidably engaged with the keycap.

Accordingly, the keyboard device of the present disclosure guides the movements of the keycap toward and away from the base plate by the two linkages, and achieves the purpose of returning the keycap to its original position while not being pressed by the two magnetic attraction members that are rotatably connected to the two linkages respectively and attract each other. The magnetic attraction members can replace the conventional rubber dome, so as to effectively shorten the stroke of the keycap and facilitate the thinning of the keyboard device.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
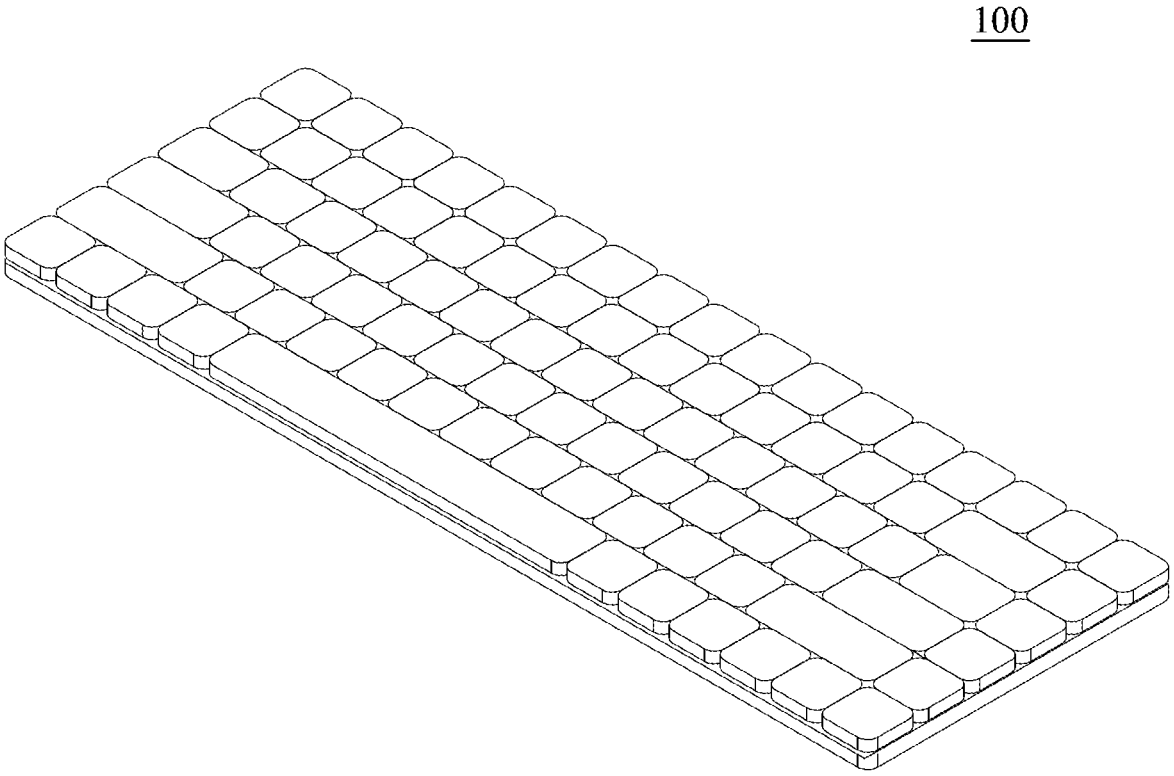
FIG. 1A is a perspective view of a keyboard device according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing exemplary embodiments, and thus may be embodied in many alternate forms and should not be construed as limited to only exemplary embodiments set forth herein. Therefore, it should be understood that there is no intent to limit exemplary embodiments to the particular forms disclosed, but on the contrary, exemplary embodiments are to cover all modifications, equivalents, and alternatives falling within the scope of the disclosure.

Figure 1B:
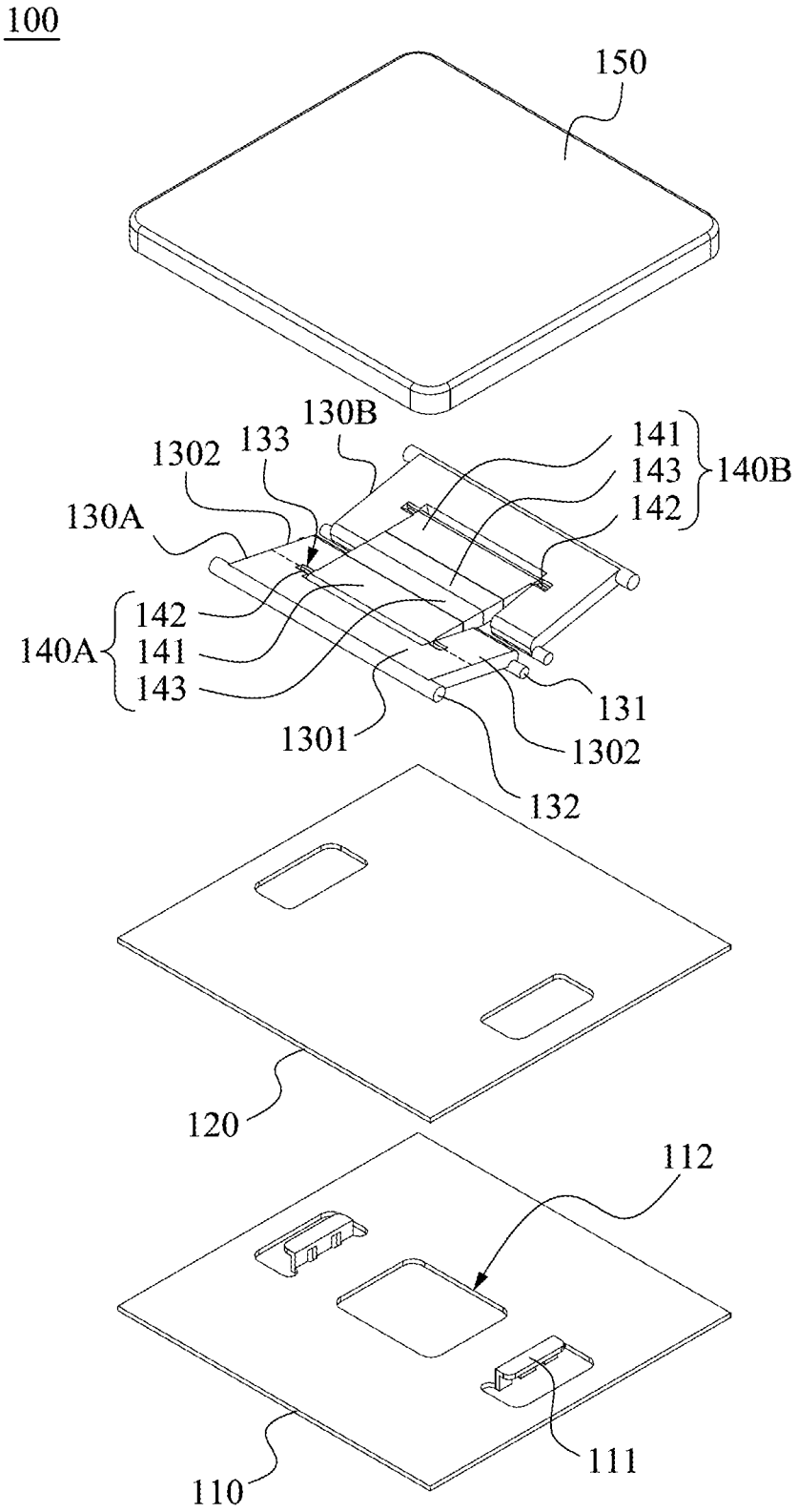
FIG. 1B is a partial exploded view of the keyboard device in FIG. 1A.

Reference is made to FIGS. 1A and 1B. FIG. 1A is a perspective view of a keyboard device 100 according to an embodiment of the disclosure. FIG. 1B is a partial exploded view of the keyboard device 100 in FIG. 1A. As shown in FIGS. 1A and 1B, the keyboard device 100 of the disclosure can be an external keyboard (e.g., a keyboard with a PS/2 interface or a keyboard with a USB interface) used in a desktop computer, or can be a part of a computer system having an input device (e.g., a touch pad on a notebook computer) that is in the form of a keyswitch, but the disclosure is not limited in this regard. That is, concepts of the keyboard device 100 of the disclosure can be used in any electronic product that performs input function by pressing.

Figure 2A:
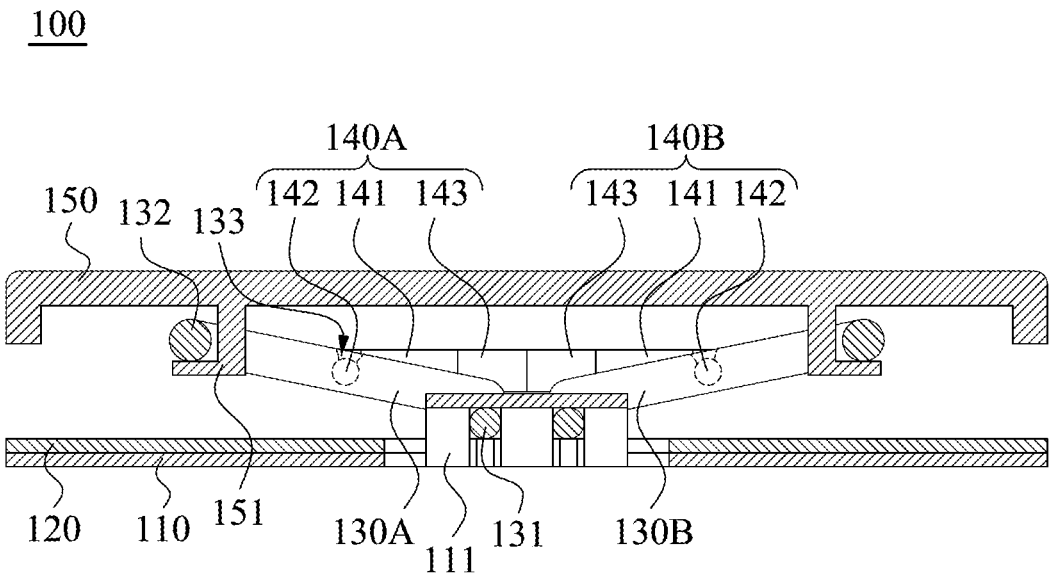
FIG. 2A is a partial cross-sectional view of the keyboard device in FIG. 1A, in which a keycap is located at a highest position relative to a base plate.
Figure 2B:
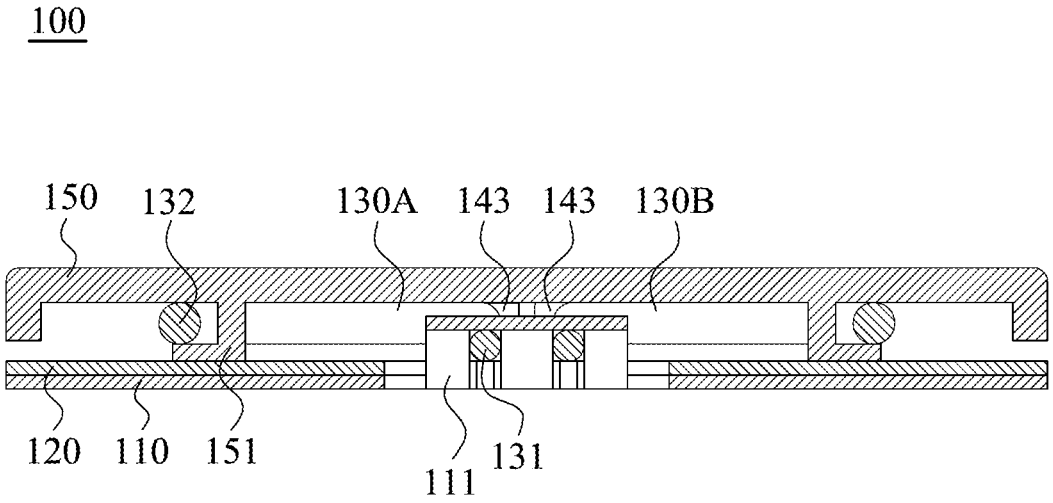
FIG. 2B is another partial cross-sectional view of the keyboard device in FIG. 1A, in which the keycap is located at a lowest position relative to the base plate.

Reference is made to FIGS. 2A and 2B. FIG. 2A is a partial cross-sectional view of the keyboard device 100 in FIG. 1A, in which a keycap 150 is located at a highest position relative to a base plate 110. FIG. 2B is another partial cross-sectional view of the keyboard device 100 in FIG. 1A, in which the keycap 150 is located at a lowest position relative to the base plate 110. Structures and functions of components included in the keyboard device 100 and connection and operation relationships among these components are described in detail below.

As shown in FIGS. 1A-2B, in the present embodiment, the keyboard device 100 includes a base plate 110 and a plurality of keyswitches. The keyswitches are disposed on the base plate 110. At least one of the keyswitches includes a circuit board 120, two linkages 130A, 130B, two magnetic attraction members 140A, 140B, and a keycap 150. The keycap 150 is located over the base plate 110. The circuit board 120 is disposed on the base plate 110 and located between the base plate 110 and the keycap 150. The linkages 130A, 130B are connected between the base plate 110 and the keycap 150 and configured to guide movements of the keycap 150 toward and away from the base plate 110. The magnetic attraction members 140A, 140B are rotatably connected to the linkages 130A, 130B respectively and configured to attract each other. When the magnetic attraction members 140A, 140B abut against each other (referring to FIG. 2A), the keycap 150 is at a highest position relative to the base plate 110. When the keycap 150 moves toward the base plate 110 from the highest position (referring to FIG. 2B), the magnetic attraction members 140A, 140B are separated from each other.

With the foregoing structural configurations, the keyboard device 100 of the present embodiment can achieve the purpose of returning the keycap 150 to the highest position while not being pressed by the two magnetic attraction members 140A, 140B that are rotatably connected the two linkages 130A, 130B respectively and attract each other. Therefore, the magnetic attraction members 140A, 140B can replace the conventional rubber dome, so as to effectively shorten the stroke of the keycap 150 and facilitate the thinning of the keyboard device 100. Furthermore, because of being rotatably connected to the two linkages 130A, 130B respectively, the two magnetic attraction members 140A, 140B can simultaneously decline and maintain the level by the guidance of the two linkages 130A, 130B when the keycap 150 moves relative to the base plate 110 from the highest position (FIG. 2A) to the lowest position (FIG. 2B). As a result, ends of the two magnetic attraction members 140A, 140B can be prevented from hitting or abutting the keycap 150, so that the pressing feeling of users can be improved and the height of the keyboard device 100 can be effectively reduced.

As shown in FIG. 1B, in the present embodiment, each of the linkages 130A, 130B has a lower engaging shaft 131 (only one of which is representatively labeled) and an upper engaging shaft 132 (only one of which is representatively labeled). The lower engaging shaft 131 and the upper engaging shaft 132 are respectively engaged with the base plate 110 and the keycap 150. As shown in FIG. 2A, the linkages 130A, 130B are arranged horizontally and symmetrically. With the structural configurations, even though a conventional scissors-like mechanism is not adopted, the linkages 130A, 130B adopted in the keyboard device 100 of the present embodiment can still provide enough structural strength and effectively avoid function failure caused by wobbling when the corners of the keycap 150 are pressed.

In the present embodiment, a distance between two lower engaging shafts 131 is smaller than a distance between two upper engaging shafts 132. That is, the two linkages 130A, 130B constitute a V shape shown in FIG. 2A, and the two magnetic attraction members 140A, 140B extend toward each other and attract each other. However, the present disclosure is not limited in this regard. In some other embodiments, the two linkages 130A, 130B constitute an inverted V shape. That is, the distance between two upper engaging shafts 132 is smaller than the distance between two lower engaging shafts 131.

As shown in FIG. 2A, the lower engaging shafts 131 of the two linkages 130A, 130B are pivotally connected to the base plate 110. The upper engaging shafts 132 of the two linkages 130A, 130B are slidably engaged with the keycap 150. Specifically, the keycap 150 has two upper engaging structures 151 (only one of which is representatively labeled). Each of the two upper engaging structures 151 has a sliding chute. The upper engaging shafts 132 of the two linkages 130A, 130B are slidably engaged with the two sliding chutes, respectively. In addition, the base plate 110 has lower engaging structures 111 (only one of which is representatively labeled). The lower engaging structures 111 pass through the circuit board 120 to pivotally connect to the lower engaging shafts 131 of the two linkages 130A, 130B.

However, the present disclosure is not limited in this regard. In some other embodiments, the two upper engaging structures 151 of the keycap 150 can also be interchanged with the lower engaging structures 111 of the base plate 110. That is, the two upper engaging shafts 132 can be changed to rotatably engage with the keycap 150, and the two lower engaging shafts 131 can be changed to slidably engage with the base plate 110 correspondingly.

As shown in FIG. 1B, in the present embodiment, each of the magnetic attraction members 140A, 140B includes a main body portion 141, a connecting portion 142, and a magnetic attraction portion 143. The two main body portions 141 are rotatably connected to the two linkages 130A, 130B through the two connecting portions 142, respectively. The two magnetic attraction portions 143 are connected to the two main body portions 141, respectively.

Moreover, each of the two connecting portions 142 is substantially located at the center of the upper engaging shaft 132 and the lower engaging shafts 131 of one of the two linkages 130A, 130B connected thereto. In each of the two magnetic attraction members 140A, 140B, the connecting portion 142 and the magnetic attraction portion 143 are respectively adjacent to two opposite side edges of the main body portion 141. The two magnetic attraction portions 143 are respectively connected to outer edges of the two main body portions 141, so that the two magnetic attraction portions 143 could attract each other.

In the present embodiment, the two connecting portions 142 are pivotal shafts and are pivotally connected to the two linkages 130A, 130B, respectively. Specifically, as shown in FIGS. 1B and 2A, the linkages 130A, 130B have pivotal holes 133 (only one of which is representatively labeled). The two pivotal holes 133 are pivotally connected to the two connecting portions 142, respectively. Each of the pivotal holes 133 has an entrance. The entrance inwardly shrinks relative to the pivotal hole 133, so a combination of the entrance and the pivotal hole 133 is also known as a drop hole. While assembling, a user can make the pivotal shafts be rotatably engaged with the pivotal holes 133 by pressing the pivotal shafts through the entrances (by the plastic deformation capacity of the linkages 130A, 130B). In addition, in the present disclosure, the entrances are located at a side of the linkages 130A, 130B facing toward the keycap 150 and away from the base plate 110, so as to easily assemble the pivotal shafts from top to bottom, but the disclosure is not limited in this regard.

In some embodiments, one of the magnetic attraction portions 143 is a magnet, and another of the magnetic attraction portions 143 includes a ferromagnetic material, so as to achieve the purpose of attracting each other. Alternatively, in some other embodiments, the two magnetic attraction portions 143 are magnets with opposite magnetic poles facing toward each other, but the disclosure is not limited in this regard. In some embodiments, the connecting portion 142 and the main body portion 141 of each of the magnetic attraction members 140A, 140B can include the same material, but the disclosure is not limited in this regard.

In some embodiments, the base plate 110 includes a ferromagnetic material and has a hole 112. When the keycap 150 is at the lowest position relative to the base plate 110, orthogonal projections of the two magnetic attraction portions 143 projected onto the base plate 110 are contained within the hole 112. Therefore, when the keycap 150 moves relative to the base plate 110 to the lowest position (referring to FIG. 2B), the two magnetic attraction portions 143 can be prevented from attracting the base plate 110 to cause the keycap 150 unable to return.

As shown in FIG. 1B, each of the linkages 130A, 130B includes a first arm 1301 and two second arms 1302 (only one of which is representatively labeled). The first arm 1301 is connected parallel to the upper engaging shaft 132. Each of the second arms 1302 is connected between the first arm 1301 and the lower engaging shaft 131. The second arms 1302 are respectively extended from two ends of the first arm 1301. As such, each of the linkages 130A, 130B is U-shaped. The two magnetic attraction members 140A, 140B can respectively swing at the U-shaped inner edges of the two linkages 130A, 130B. With the structural configurations, when the keycap 150 moves relative to the base plate 110 between the highest position (referring to FIG. 2A) and the lowest position (referring to FIG. 2B), the attraction and separation between the magnetic attraction portions 143 of the magnetic attraction members 140A, 140B do not obstructed by the linkages 130A, 130B.

Figure 3:
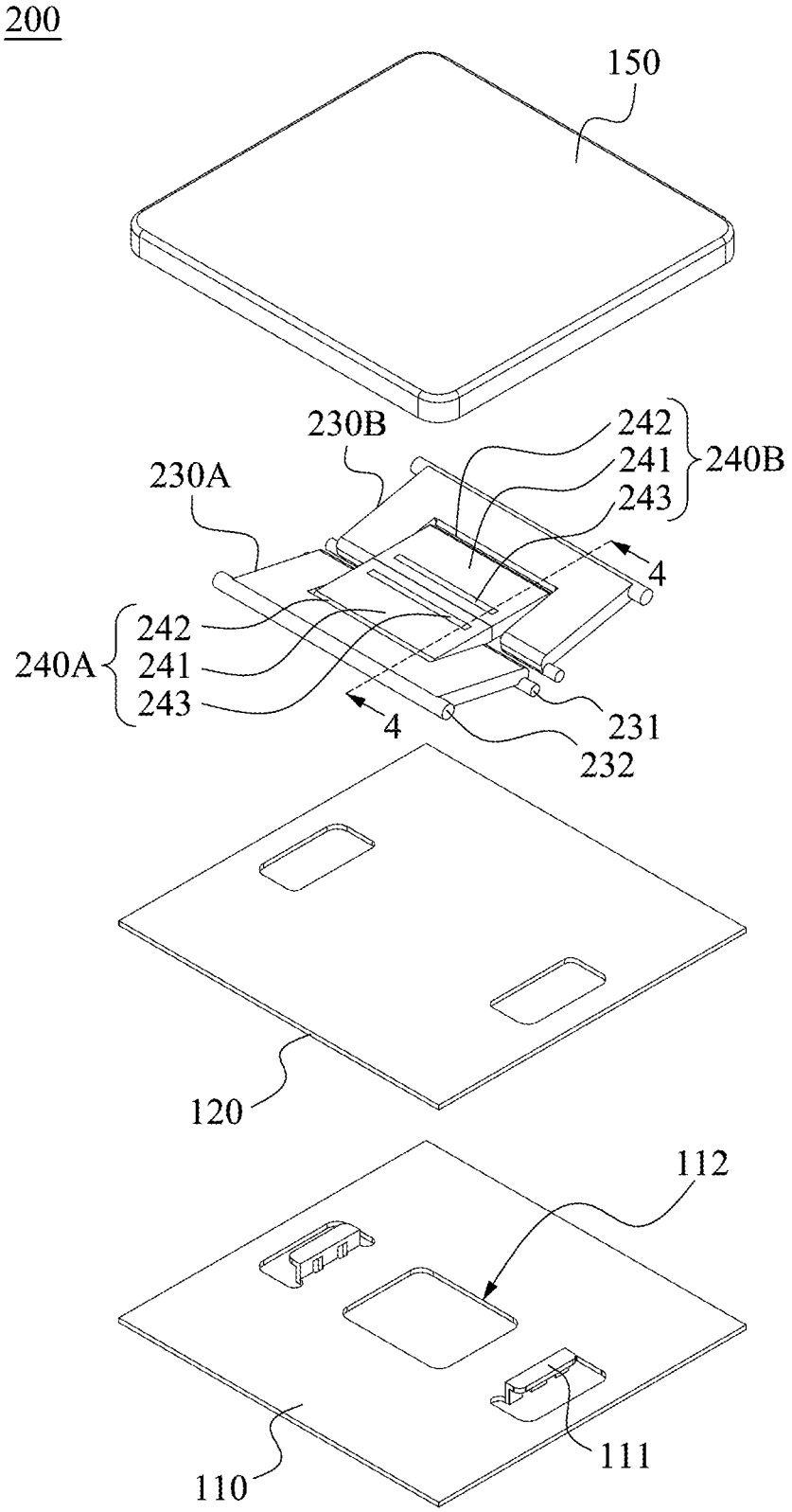
FIG. 3 is a partial exploded view of a keyboard device according to another embodiment of the disclosure.
Figure 4:
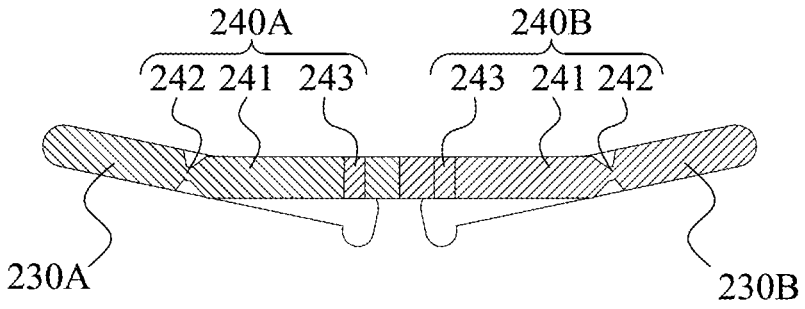
FIG. 4 is a cross-sectional view of certain components in FIG. 3 taken along line 4-4.

Reference is made to FIGS. 3 and 4. FIG. 3 is a partial exploded view of a keyboard device 200 according to another embodiment of the disclosure. FIG. 4 is a cross-sectional view of certain components in FIG. 3 taken along line 4-4. As shown in FIGS. 3 and 4, in the present embodiment, the keyboard device 200 includes a base plate 110, a circuit board 120, two linkages 230A, 230B, two magnetic attraction members 240A, 240B, and a keycap 150, in which the base plate 110, the circuit board 120, and the keycap 150 are identical or similar to those of the embodiment shown in FIG. 1B, so the introductions can be referred to the above related descriptions and not repeated here for simplicity. In addition, the two linkages 230A, 230B and the lower engaging shafts 231 (only one of which is representatively labeled) and the upper engaging shaft 232 (only one of which is representatively labeled) thereof are identical or similar to the two linkages 130A, 130B and the lower engaging shafts 131 and the upper engaging shaft 132 thereof illustrated in FIG. 1B, so the introductions can be referred to the above related descriptions and not repeated here for simplicity.

It should be pointed out that compared with the embodiment shown in FIG. 1B, the structures of the two magnetic attraction members 240A, 240B are modified in the present embodiment. In the present embodiment, each of the two magnetic attraction members 240A, 240B includes a main body portion 241, a connecting portion 242, and a magnetic attraction portion 243.

A difference between the present embodiment and the embodiment shown in FIG. 1B is that each connecting portion 242 and the corresponding one of the linkages 230A, 230B are formed in one piece. That is, each of the linkages 230A, 230B and the corresponding one of the magnetic attraction members 240A, 240B connected thereto can be a unitary component that is integrally formed. Furthermore, a thickness of the connecting portion 242 is reduced relative to the main body portion 241 and the corresponding one of the linkages 230A, 230B connected thereto, such that the connecting portion 242 forms a flexible structure. As a result, the two main body portions 241 can also achieve the purpose of rotatably connecting the two linkages 230A, 230B through the two connecting portions 242, respectively.

Another difference between the present embodiment and the embodiment shown in FIG. 1B is that the two magnetic attraction portions 243 of the present embodiment are respectively embedded in the two main body portions 241. As a result, the two magnetic attraction portions 243 can effectively avoid wear and tear caused by directly contacting.

According to the foregoing recitations of the embodiments of the disclosure, it can be seen that the keyboard device of the present disclosure guides the movements of the keycap toward and away from the base plate by the two linkages, and achieves the purpose of returning the keycap to its original position while not being pressed by the two magnetic attraction members that are rotatably connected the two linkages respectively and attract each other. The magnetic attraction members can replace the conventional rubber dome, so as to effectively shorten the stroke of the keycap and facilitate the thinning of the keyboard device.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard device, comprising:

a base plate; and a plurality of keyswitches disposed on the base plate, at least one of the keyswitches comprising:

a keycap located over the base plate;

two linkages connected between the base plate and the keycap and configured to guide movements of the keycap toward and away from the base plate; and two magnetic attraction members rotatably connected to the linkages respectively and configured to attract each other, wherein when the magnetic attraction members abut against each other, the keycap is at a highest position relative to the base plate, and when the keycap moves toward the base plate from the highest position, the magnetic attraction members are separated from each other.

2. The keyboard device of claim 1, wherein one of the magnetic attraction members comprises:

a main body portion;

a connecting portion, wherein the main body portion is rotatably connected to a corresponding one of the linkages through the connecting portion; and a magnetic attraction portion connected to the main body portion.

3. The keyboard device of claim 2, wherein the connecting portion is a pivotal shaft and is pivotally connected to said corresponding one of the linkages.

4. The keyboard device of claim 2, wherein the connecting portion and the linkage connected thereto are formed in one piece, and a thickness of the connecting portion is reduced relative to the main body portion and the linkage connected thereto, such that the connecting portion forms a flexible structure.

5. The keyboard device of claim 2, wherein the connecting portion and the magnetic attraction portion are respectively adjacent to two opposite side edges of the main body portion.

6. The keyboard device of claim 2, wherein the magnetic attraction portion is connected to an outer edge of the main body portion.

7. The keyboard device of claim 2, wherein the magnetic attraction portion is embedded in the main body portion.

8. The keyboard device of claim 2, wherein the magnetic attraction portion is a magnet or comprises a ferromagnetic material.

9. The keyboard device of claim 2, wherein the magnetic attraction portion is a magnet, the base plate has a hole, and when the keycap is at a lowest position relative to the base plate, an orthogonal projection of the magnetic attraction portion projected onto the base plate is contained within the hole.

10. The keyboard device of claim 1, wherein each of the linkages has a lower engaging shaft and an upper engaging shaft respectively engaged with the base plate and the keycap, and the linkages are arranged horizontally and symmetrically.

11. The keyboard device of claim 10, wherein each of the linkages is U-shaped and comprises a first arm and two second arms, the first arm is connected parallel to the upper engaging shaft, each of the second arms is connected between the first arm and the lower engaging shaft, and the second arms are respectively extended from two ends of the first arm.

12. The keyboard device of claim 11, wherein a distance between the lower engaging shafts is smaller than a distance between the upper engaging shafts, and the magnetic attraction members extend toward each other.

13. The keyboard device of claim 11, wherein at least one of the lower engaging shafts is pivotally connected to the base plate, and at least one of the upper engaging shafts is slidably engaged with the keycap.

* * * * *